United States Patent [19]

Jauch

[11] 4,202,165

[45] May 13, 1980

[54] BELLOWLESS CUCKOO CLOCK

[75] Inventor: Christian M. J. Jauch, Louisville, Miss.

[73] Assignee: Spartus Corporation, Chicago, Ill.

[21] Appl. No.: 864,255

[22] Filed: Dec. 27, 1977

[51] Int. Cl.[2] ..... G04B 21/08

[52] U.S. Cl. ..... 368/272; 368/65

[58] Field of Search ..... 58/7, 12, 13, 42

[56] References Cited

U.S. PATENT DOCUMENTS

| | | | |
|---|---|---|---|
| 465,441 | 12/1891 | Weisser | 58/12 |
| 2,574,703 | 11/1951 | Paul et al. | 58/12 |

FOREIGN PATENT DOCUMENTS

| | | | |
|---|---|---|---|
| 451225 | 10/1927 | Fed. Rep. of Germany | 58/42 |
| 1194783 | 6/1965 | Fed. Rep. of Germany | 58/12 |
| 2134694 | 1/1973 | Fed. Rep. of Germany | 58/12 |
| 2449744 | 4/1976 | Fed. Rep. of Germany | 58/12 |

*Primary Examiner*—J. V. Truhe
*Assistant Examiner*—Forester W. Isen
*Attorney, Agent, or Firm*—Merriam, Marshall & Bicknell

[57] ABSTRACT

A cuckoo clock has a clock mechanism and a pair of whistles for producing the cuckoo sound. An air stream is flowed sequentially through the two whistles by bellowless mechanical structure actuated by the clock mechanism.

3 Claims, 11 Drawing Figures

BELLOWLESS CUCKOO CLOCK

BACKGROUND OF THE INVENTION

The present invention relates generally to clocks and more particularly to cuckoo clocks in which the familiar cuckoo sound is produced by directing a stream of air through a whistle without using a bellows.

A conventional cuckoo clock employs a pair of whistles each producing a different note. When played in sequence, they produce the familiar cuckoo sound. The sound is produced by blowing an air stream through each of the two whistles, sequentially, and, conventionally, the air stream has been generated by the opening and closing of a small bellows driven by mechanical structure actuated by the clock mechanism.

The bellows is constructed of flexible, airimpervious material which renders the bellows inflatable and expandable. This material is expensive, difficult to assemble and subject to age cracking which, when it occurs, impairs the bellows and leaves the chuckoo whistle inoperative.

SUMMARY OF THE INVENTION

The present invention eliminates the drawbacks of the prior art cuckoo clocks by eliminating the bellows entirely. Instead, the cuckoo clock utilizes bellowless mechanical means for actuating the cuckoo whistle to produce the cuckoo sound. As used herein, the phrase "bellowless mechanical means for actuating the cuckoo whistle" refers to uninflatable, unexpandable, rigid, mechanical means having contours and dimensions which remain unchanged during the production of the cuckoo sound. This phrase also excludes, from inclusion in the cuckoo clock of the present invention, recordings such as tapes, discs and the like, for producing the cuckoo sound.

A cuckoo whistle conventionally includes an entry opening and an exit opening, with air being flowed sequentially in a downstream direction into the entry opening, through the interior of the cuckoo whistle and out of the exit opening, to produce the cuckoo sound. The bellowless mechanical means of the present invention comprises structure for flowing air downstream along the path described above and closure structure for blocking the flow of air through the entry opening after a stream of air has flowed downstream through the entry opening for a time period corresponding to the length of one note of the cuckoo sound. The bellowless mechanical means also comprises movable means for producing the air stream at preselected intervals determined by the clock mechanism together with means for directing the air stream into the cuckoo whistle.

Other features and advantages are inherent in the structure claimed and disclosed or will become apparent to those skilled in the art from the following detailed description in conjunction with the accompanying diagrammatic drawings.

DETAILED DESCRIPTION OF THE DRAWINGS

Figure 1:
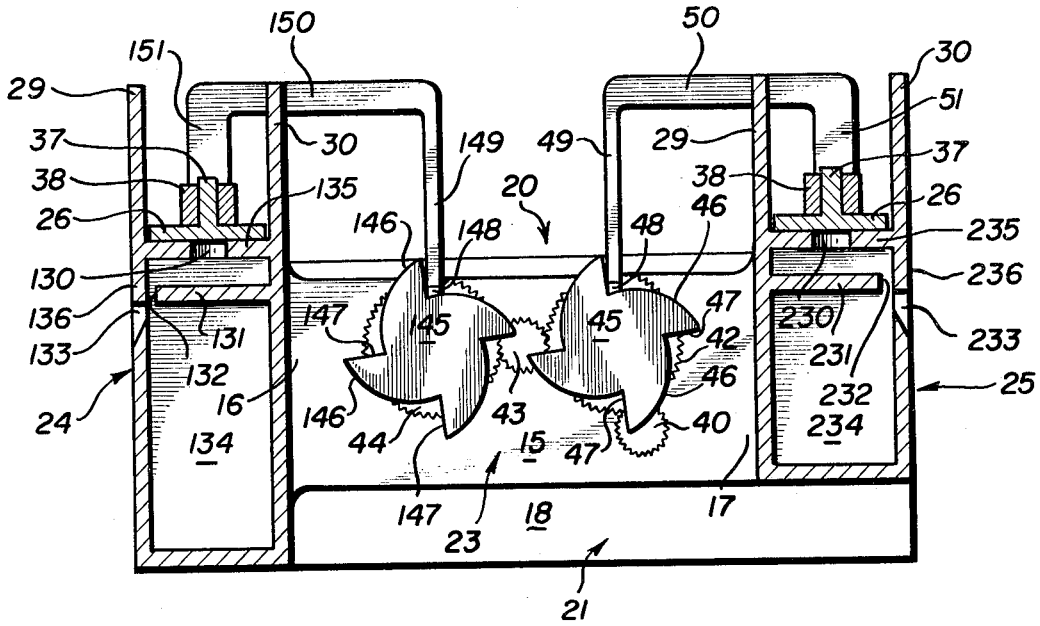
FIG. 1 is a rear view, partially in section, of a portion of a cuckoo clock constructed in accordance with an embodiment of the present invention.
Figure 2:
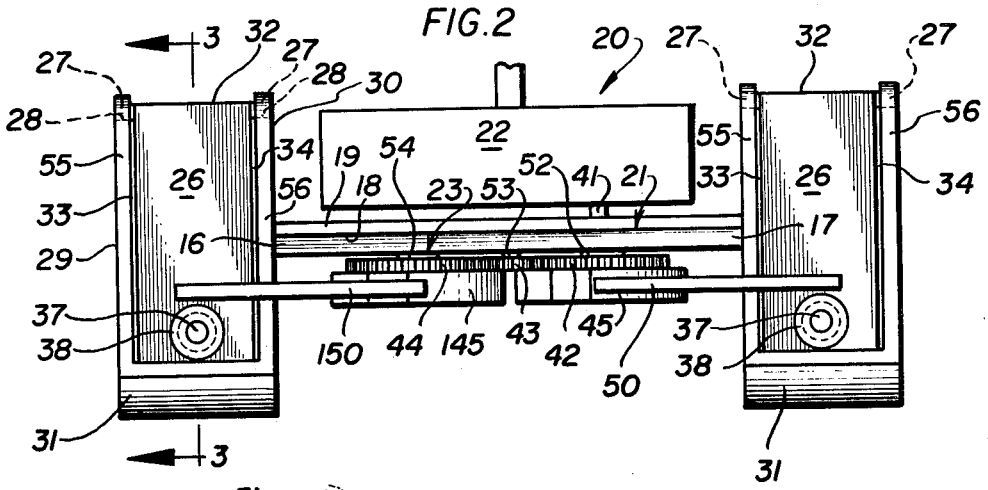
FIG. 2 is a top view of the structure of FIG. 1.

Referring to FIGS. 1 and 2, indicated generally at 20 is a portion of a cuckoo clock comprising a back plate 21 having a front side 19 on which is mounted a mechanical clock mechanism 22 of conventional construction driven by an electric motor, for example.

Attached to the rear side 18 of plate 21, by conventional means (not shown), is a web member 23 having opposite end portions 16, 17 each integral with a respective one of a pair of cuckoo whistles 24, 25.

Each cuckoo whistle 24, 25, respectively comprises an entry opening 130, 230, a partition member 131, 231, a slot 132, 232 between the partition member and an adjacent exterior wall 136, 236 of the cuckoo whistle, an exit opening 133, 233, and a chamber 134, 234. To produce the cuckoo sound, air is flowed sequentially in a downstream direction into entry opening 130, 230, through slot 132, 232 past partition member 131, 231 and out of exit opening 133, 233. As shown in the drawings, cuckoo whistles 24, 25 have different lengths each to produce a different note of the two-note cuckoo sound.

Air is flowed through each of the two cuckoo whistles 24, 25, in the embodiment of FIGS. 1–4, by operation of a pair of flaps 26, 26 one of which is associated with each whistle. Each flap 26 comprises a front end 32, a pair of sides 33, 34 and a rear end 35 from which extend in opposite directions a pair of pin portions 27, 27 pivotally received in grooves 28, 28 (FIG. 3) in a pair of side walls 29, 30 extending upwardly from the top wall 135 or 235 of whistles 24, 25, respectively. Also extending upwardly from top walls 135, 235, are curved front walls 31, 31.

Figure 3:
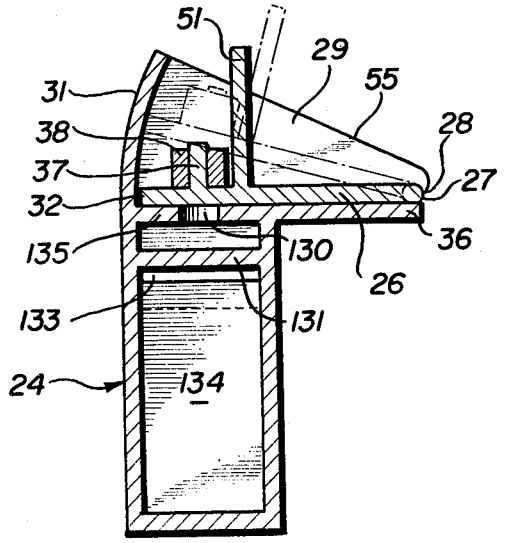
FIG. 3 is a sectional view taken along line 3—3 of FIG. 2.

Flap 26 is mounted for pivotal movement, about the axis of pin portions 27, 27, between the lower and upper positions shown in full lines and dash-dot lines, respectively, in FIG. 3. The curve of front wall 31 corresponds to the arc described by the front end 32 of flap 26 when the latter pivots.

Extending upwardly from flap 26 is a stud 37 around which is fitted a weight 38 for urging flap 26 downwardly.

Lifting flap 26 and then releasing it creates an air stream below flap 26 which is directed through openings 130, 230 in cuckoo whistles 24, 25, as the flap descends. As shown in the drawing, front end 32 of flap 26 is closely spaced relative to curved front wall 31, and flap sides 33, 34 are closely spaced relative to the interior surfaces of side walls 29, 30. The clearance between flap 26 and the adjoining walls 29, 30, 31 is sufficiently small to prevent substantial amounts of air from escaping upwardly around the flap's periphery during the flap's descent.

The lifting and releasing of the flap 26 is performed at preselected intervals, determined by the clock mechanism, utilizing structure now to be described.

Located on the rear surface 15 of web 23 is a drive pinion 40 driven by a shaft 41 drivably connected to clock mechanism 22. Drive pinion 40 drives a gear 42 driving an idler pinion 43 in turn driving another gear 44. Gear 42, idler pinion 43 and gear 44 are mounted on respective shafts 52, 53, 54 each extending rearwardly from web member 23. Integral with each of gears 42, 44 is a cam 45, 145 each having a plurality of cam rises 46, 146 and drop-offs 47, 147 along which rides a cam follower 48, 148 connected by connecting portions 49–51 and 149–151 to flaps 26, 26 on whistles 25 and 24, respectively.

The structure for raising and dropping flaps 26 operates as follows. At preselected intervals determined by the clock mechanism utilizing conventional structure within the skill of the ordinary clock-making artisan, shaft 41 is driven, in turn driving drive pinion 40 which drives gear 42 which drives idler pinion 43 which drives gear 44.

The rotation of gears 42, 44 rotates their respective cams 45, 145 causing cam followers 48, 148 to rise along cam rises 46, 146 and fall at drop-offs 47, 147. As each cam follower 48, 148 rises and falls, this in turn raises and drops the respective associated flaps 26, 26 thereby causing a stream of air to flow through the cuckoo whistles 24, 25 to produce the cuckoo sound.

Cam 145, associated with the flap 26 on cuckoo whistle 24, is set so that the associated cam follower 148 drops off a cam rise 146 at a drop-off 147 immediately after cam follower 48 associated with cam 45 has reached the bottom of its drop-off 47. This causes a slight delay in actuation of cuckoo whistle 24 relative to cuckoo whistle 25 so as to separate the two notes of the cuckoo sound.

As noted above, the descent of a flap 26 causes an air stream to be flowed through an entry opening 130, 230 of its respective cuckoo whistle. When a flap 26 reaches the bottom of its descent, it closes the entry opening blocking the flow of air through the entry opening in any direction. The time during which a stream of air flows downstream through each of the entry openings 130, 230 corresponds to the length of one note of the cuckoo sound. This time in turn corresponds to the length of time of descent of a flap 26 in turn corresponding to the length of time of descent of a cam follower 48, 148 at cam drop-offs 47, 147.

In the embodiment of FIGS. 1–3, the descent of flap 26 is assisted by the gravity urging of weight 38. Another manner of assisting flap descent is illustrated in FIG. 4 which shows a substantially circular spring clip 60 having a pair of ends 61, 62 each respectively received within a groove 63 in flap 26 and a groove 64 in a flap platform 36 extending from the top wall of the cuckoo whistle.

Figure 4:
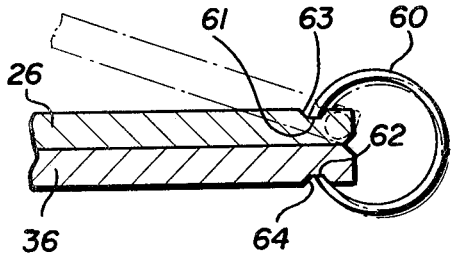
FIG. 4 is an enlarged sectional view of an embodiment of a hinge structure for use with the present invention.

Spring clip 60 normally assumes the configuration shown in full lines in FIG. 4. When flap 26 is raised, it expands and loads spring clip 60 so that, when the cam follower drops off the cam, the tendency of spring clip 60 to return to its normal position in turn urges flap 26 to descend.

During the time flap 26 is raised, its maximum elevation never exceeds the top edges 55, 56 of side walls 29, 30 between which flap 26 is located during its rise and descent. As shown in FIG. 3, top edges 55, 56 slope rearwardly from curved front wall 31 toward the pivotal axis of flap 26, at 27.

Cuckoo whistles 24, 25 produce the two-note cuckoo sound for each quarter rotation of cams 145 and 45. The number of rotations or fraction of rotation of cam 145 or 45, at a given time of day, is determined by the clock mechanism.

As shown in FIGS. 1–3, web member 23, cuckoo whistles 24, 25, walls 29, 30, 31 and flap platform 36 are all integral with each other and may be molded from plastic material.

Figure 5:
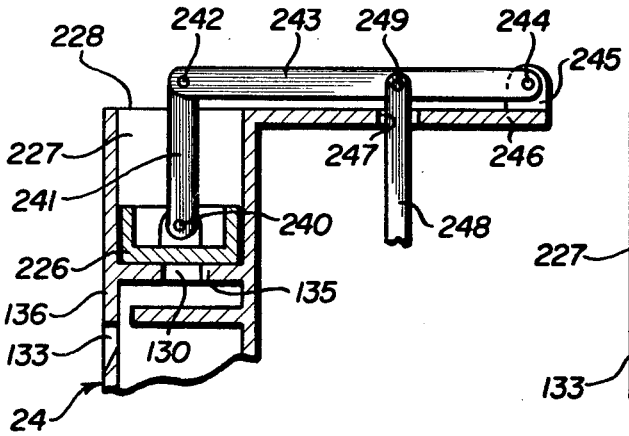
FIG. 5 is a fragmentary sectional view of another embodiment of structure in accordance with the present invention.
Figure 6:
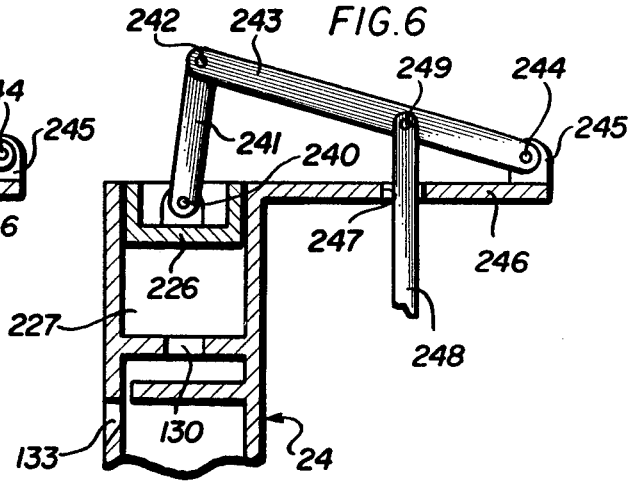
FIG. 6 is a view similar to FIG. 5, showing the structure of FIG. 5 in a different position than that shown in FIG. 5.
Figure 7:
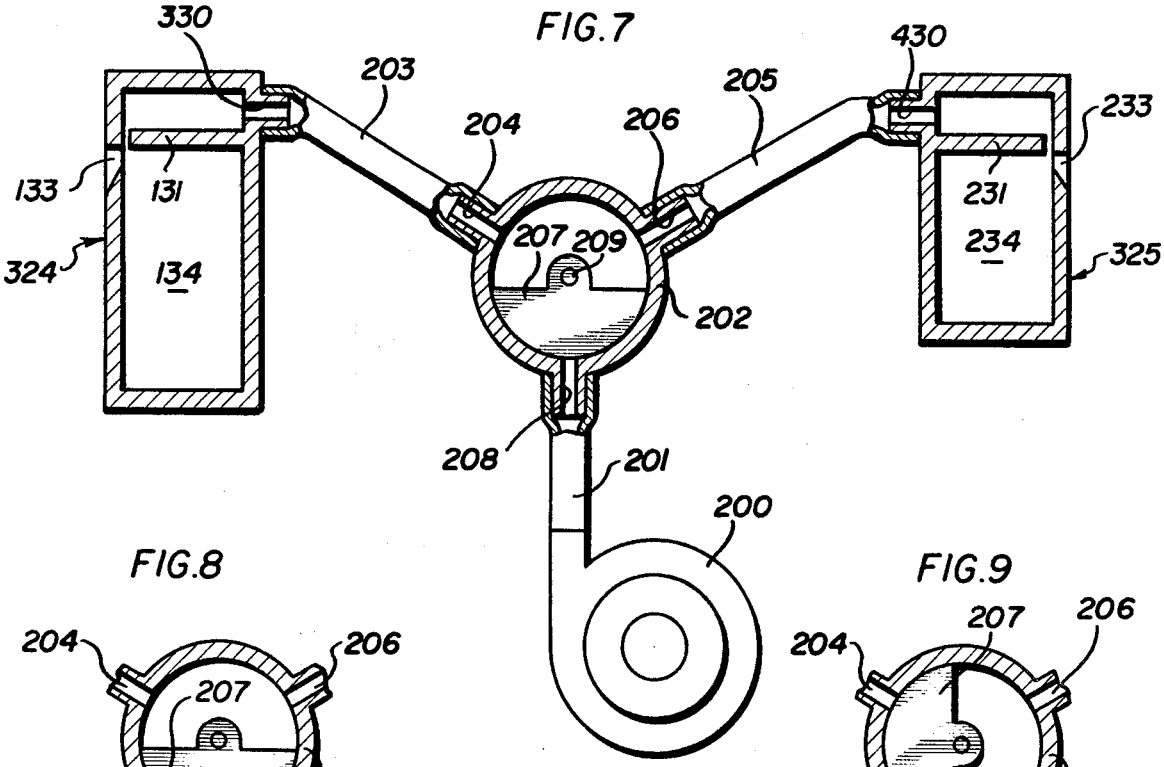
FIG. 7 is a diagrammatic view, partially in section, of a further embodiment of structure in accordance with the present invention.

FIGS. 5–6 illustrate an embodiment wherein air is flowed through the entry opening 130 of a cuckoo whistle 24 by a piston 226 reciprocating within a cylinder 227. Cylinder 227 extends integrally from cuckoo whistle 24 and surrounds the entry opening 130 in top wall 135 of the cuckoo whistle.

Cylinder 227 has an open upper or outer end 228 through which extends a piston rod 241 having an inner end pivotally connected at 240 to piston 226 and an outer end pivotally connected at 242 to a horizontally extending first link member 243 pivotally connected at 244 to an ear 245 on a platform 246 extending from cylinder 227 adjacent its outer end 228. Platform 246 has an opening 247 through which extends a second link member 248 pivotally connected at 249 to first link member 243. The lower end (not shown) of second link member 248 terminates at a cam follower, such as 148 in FIG. 1, which follows cam 145 the same as in the embodiment illustrated in FIG. 1. This causes second link member 248 to rise and fall in turn pivoting first link member 243 upwardly and downwardly about the pivotal connection at 244.

Piston 226 is free to slide up and down within cylinder 227. As second link member 248 rises, it raises first link member 243, piston rod 241 and piston 226, from the position shown in FIG. 5 to the position shown in FIG. 6. As this occurs, air is drawn into cylinder 227 through openings 130 and 133 in whistle 24. When second link member 248 drops downwardly, first link member 243, piston rod 241 and piston 226 drop, due to the urging of gravity, or the urging of a spring (not shown). The downward movement of piston 226 within cylinder 227 pushes the air within the cylinder through the opening 130 into the whistle 24 to produce a note of the cuckoo sound. This note continues until piston 226 comes to rest at the bottom of cylinder 227, as shown in FIG. 5, at which point the flow of air through entry opening 130 is blocked by piston 226.

As shown in FIGS. 5 and 6, there is a small clearance between the exterior of piston 226 and the interior of cylinder 227. This clearance is sufficiently small to prevent substantial amounts of air from escaping upwardly around the periphery of the piston during the piston's descent.

A further embodiment of bellowless mechanical means for actuating the cuckoo whistle is illustrated in FIGS. 7–11. In this embodiment, air is supplied to the two cuckoo whistles, indicated generally at 324, 325, by a low pressure blower 200 driven by the clock's motor (when the clock is driven by an electric motor) or by a separate motor. In the embodiment of FIGS. 7–11, the cuckoo whistles 324, 325 differ from the cuckoo whistles 24, 25 of the embodiment of FIGS. 1–3 solely in that the entry openings 330, 430 are located in the side of the cuckoo whistle rather than in the top of the cuckoo whistle as in the embodiment of FIGS. 1–3. Otherwise, cuckoo whistles 324, 325 are the same as cuckoo whistles 24, 25 of FIGS. 1-3.

When blower 200 is operating, air from blower 200 flows through a main tube 201 to a valve housing 202 connected by branch tubes 203, 205 to entry openings 330, 430 of cuckoo whistles 324, 325 respectively. Valve housing 202 has an air entry port 208, connected to main tube 201, and a pair of air exit ports 204, 206 connected to branch tubes 203, 205 respectively.

Located within valve housing 202 is a shutter 207 rotatably mounted on a shaft 209 driven by the same motor as drives blower 200. Rotation of shutter 207 within valve housing 202 directs air, flowing into valve housing 202, sequentially, through tubes 203 and 205 to sequentially actuate cuckoo whistles 324, 325.

Figure 8:
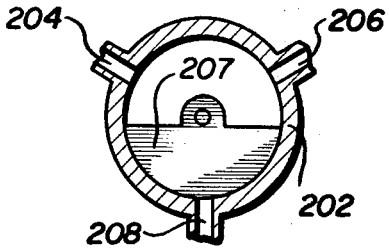
FIGS. 8–11 are diagrammatic views illustrating the operation of the embodiment of FIG. 7.
Figure 9:
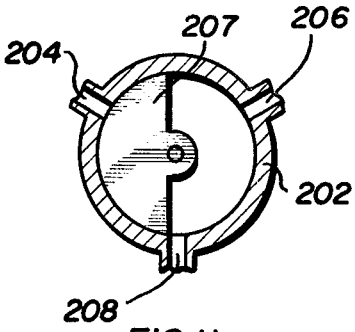
Figure 10:
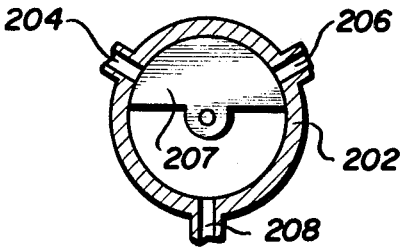

Each full revolution of rotating shutter 207 in valve housing 202 produces the two-note cuckoo sound, with the number of shutter revolutions being governed by the clock mechanism. The sequence of the positions assumed by shutter 207 to produce the two-note cuckoo sound is illustrated in FIGS. 8-11. FIG. 8 shows shutter 207 at the beginning of the cuckoo sequence. In this position, the entry of air into valve housing 202 through entry port 208 is blocked by shutter 207.

Shutter 207 rotates in a clockwise direction, as viewed in FIGS. 8-11. As the shutter rotates to the position shown in FIG. 9, air is permitted to flow in through entry port 208 of valve housing 202 and then out through exit port 206 communicating with tube 205 and cuckoo whistle 325. A single cuckoo note is produced at whistle 325, and the note continues until shutter 207 rotates to the position shown in FIG. 10 at which position the shutter blocks the further flow of air through exit port 206 (and thus through entry opening 430 of cuckoo whistle 325).

Figure 11:
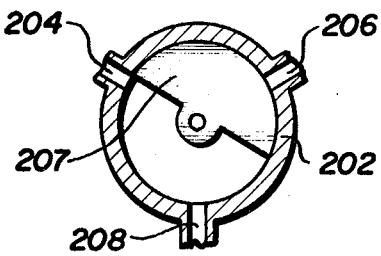

As shutter 207 continues to rotate to the position shown in FIG. 11, air is permitted to flow outwardly from valve housing 202 through exit port 204 communicating with branch tube 203 and entry opening 330 in cuckoo whistle 324. The resulting flow of air through whistle 324 produces the other note of the two-note cuckoo sound. This note continues until shutter 207 rotates to its starting position shown in FIG. 8. The entire sequence is then repeated as many times as is required to sound the appropriate number of cuckoo sounds for the particular time of day, this being determined by the clock mechanism.

Blower 200 is turned on and off in conjunction with the starting and stopping of rotation of valve shutter 207, and all of this is controlled by the clock mechanism.

The clock mechanism may be a conventional mechanical or electromechanical clock movement, and this is the type of clock mechanism contemplated for use with the structure illustrated in FIGS. 1-3, FIGS. 5-6 and FIGS. 7-11. Alternatively, the clock mechanism may be a solid state, electronic clock mechanism. In such a case, flap 26 in the embodiments of FIGS. 1-3 or piston 226 in the embodiment of FIGS. 5-6 could be raised by a solenoid actuated by the solid state, electronic clock mechanism, and returned to the position illustrated in FIGS. 1 and 5, respectively, by the action of a spring, or by gravity, once the solenoid was deactuated by the electronic, solid state clock mechanism.

An important consideration in connection with all of the embodiments of bellowless mechanical means described above is that the bellowless mechanical means includes structure which provides a flow of air in a downstream direction through the entry opening of the cuckoo whistle, toward its exit opening, and structure for blocking the flow of air through the whistle's entry opening after a stream of air has flowed downstream through the entry opening for a time period corresponding to the length of one note of the cuckoo sound.

The foregoing detailed description has been given for clearness of understanding only, and no unnecessary limitations should be understood therefrom, as modifications will be obvious to those skilled in the art.

What is claimed is:

1. In a cuckoo clock having a clock mechanism, a cuckoo whistle actuable to produce the cuckoo sound and having entry and exit openings, bellowless mechanical means for actuating said cuckoo whistle, and linking means connecting said bellowless mechanical means to said clock mechanism for automatically actuating the bellowless mechanical means at preselected intervals determined by said clock mechanism, said bellowless mechanical means comprising:

an air blower;

a valve housing having an entry port communicating with said blower and an exit port communicating with the entry opening of said cuckoo whistle;

a shutter within said valve;

and means mounting said shutter for sequential movement within said housing from a first position in which said shutter closes said entry port to an intermediate position in which neither the entry port nor the exit port is closed by the shutter to a final position in which the exit port is closed by the shutter;

said linking means comprising means connected to said shutter for actuating said sequential movement by the shutter at said preselected intervals.

2. In a cuckoo clock as recited in claim 1 and comprising:

means for turning said air blower on and off in conjunction with the starting and stopping of said sequential movement by said shutter.

3. In a cuckoo clock as recited in claim 1 wherein:

said valve housing has an additional exit port for communicating with an additional cuckoo whistle;

said shutter-mounting means comprising means mounting the shutter for sequential movement including an additional position, between said intermediate and final positions, and in which said first recited exit port is closed and said entry port and said additional exit port are both open.

* * * * *